US010088780B2

(12) United States Patent
Seko et al.

(10) Patent No.: US 10,088,780 B2
(45) Date of Patent: Oct. 2, 2018

(54) TRANSFER DEVICE AND IMAGE FORMING APPARATUS

(71) Applicant: FUJI XEROX CO., LTD., Tokyo (JP)

(72) Inventors: Masayuki Seko, Kanagawa (JP); Daisuke Tanaka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/489,804

(22) Filed: Apr. 18, 2017

(65) Prior Publication Data

US 2018/0113402 A1 Apr. 26, 2018

(30) Foreign Application Priority Data

Oct. 26, 2016 (JP) ..... 2016-209601

(51) Int. Cl.
*G03G 15/16* (2006.01)

(52) U.S. Cl.
CPC ..... *G03G 15/161* (2013.01)

(58) Field of Classification Search
USPC ..... 399/91, 98, 99, 101, 121, 350, 351, 123, 399/343
See application file for complete search history.

(56) References Cited

U.S. PATENT DOCUMENTS 6,311,031 B1 * 10/2001 Hirano ..... G03G 15/168 399/101
8,320,806 B2 * 11/2012 Takayanagi ..... G03G 15/161 399/308
9,170,556 B2 * 10/2015 Karashima ..... G03G 21/0017
9,316,955 B2 * 4/2016 Meguro ..... G03G 15/161

FOREIGN PATENT DOCUMENTS

JP 10-260589 A 9/1998
JP 2014-85595 A 5/2014

* cited by examiner

*Primary Examiner* — Hoan Tran
(74) *Attorney, Agent, or Firm* — Sughrue Mion, PLLC

(57) ABSTRACT

A transfer device includes an endless belt having a surface roughness Rz ranging approximately from 0.05 μm to 0.15 μm and a cleaning blade that serves to clean the belt and that includes a resin substrate having a substantially planar shape and a coating layer covering at least one edge of the resin substrate, wherein the coating layer has a connection layer and a surface layer, the connection layer is disposed so as to face the interface with the resin substrate and contains diamond-like carbon and at least one selected from the group consisting of titanium nitride, titanium silicon, titanium tungsten, titanium carbide, and titanium carbonitride, and the surface layer covers the connection layer and contains diamond-like carbon.

6 Claims, 6 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2016-209601 filed Oct. 26, 2016.

BACKGROUND

Technical Field

The present invention relates to a transfer device and an image forming apparatus.

SUMMARY

According to an aspect of the invention, there is provided a transfer device including an endless belt having a surface roughness Rz ranging approximately from 0.05 μm to 0.15 μm and a cleaning blade that serves to clean the belt and that includes a resin substrate having a substantially planar shape and a coating layer covering at least one edge of the resin substrate, wherein the coating layer has a connection layer and a surface layer, the connection layer is disposed so as to face the interface with the resin substrate and contains diamond-like carbon and at least one selected from the group consisting of titanium nitride, titanium silicon, titanium tungsten, titanium carbide, and titanium carbonitride, and the surface layer covers the connection layer and contains diamond-like carbon.

BRIEF DESCRIPTION OF THE DRAWINGS

Exemplary embodiment of the present invention will be described in detail based on the following figures, wherein.

DETAILED DESCRIPTION

Figure 1:
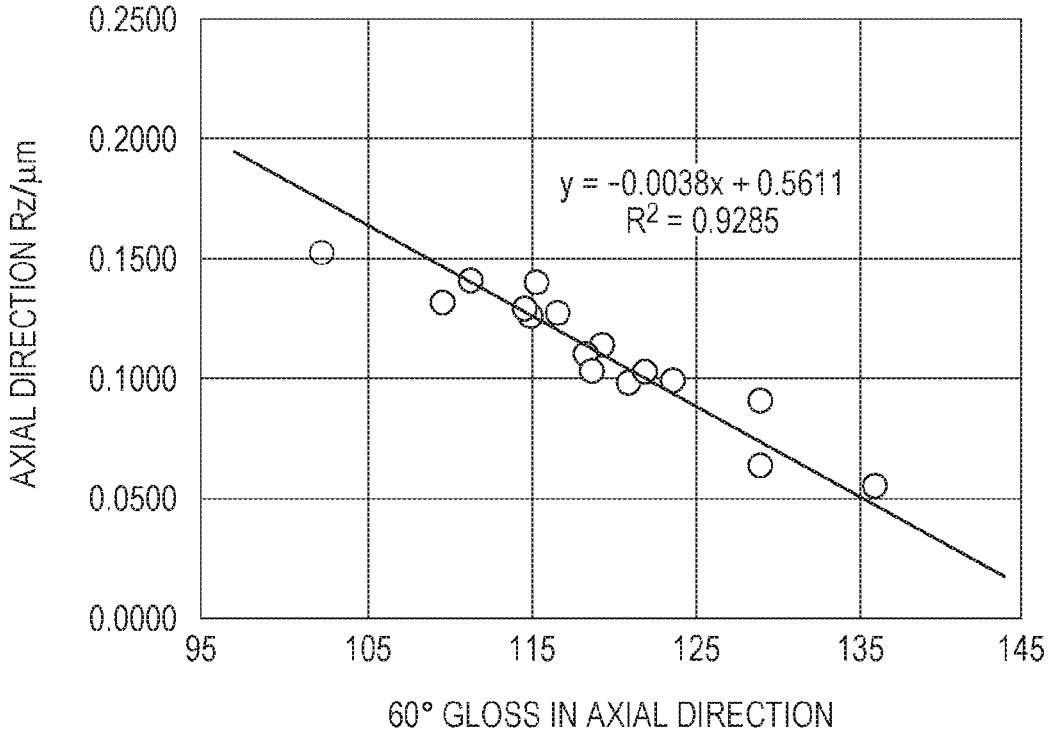
FIG. 1 illustrates a standard curve that shows the relationship between specular gloss Gs(60°) and surface roughness Rz.
Figure 2A:
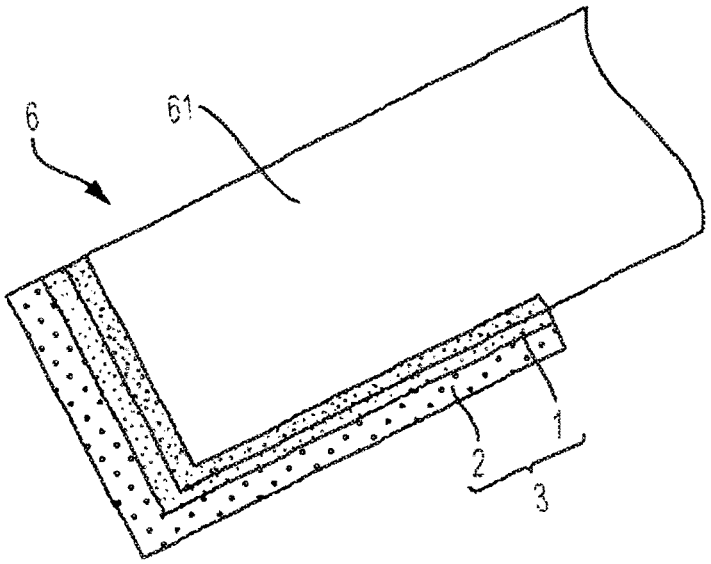
FIGS. 2A and 2B illustrate a cleaning blade 6 including a resin substrate 61 and a coating layer 3 comprising a connection layer 1 and a surface layer 2.
Figure 2B:
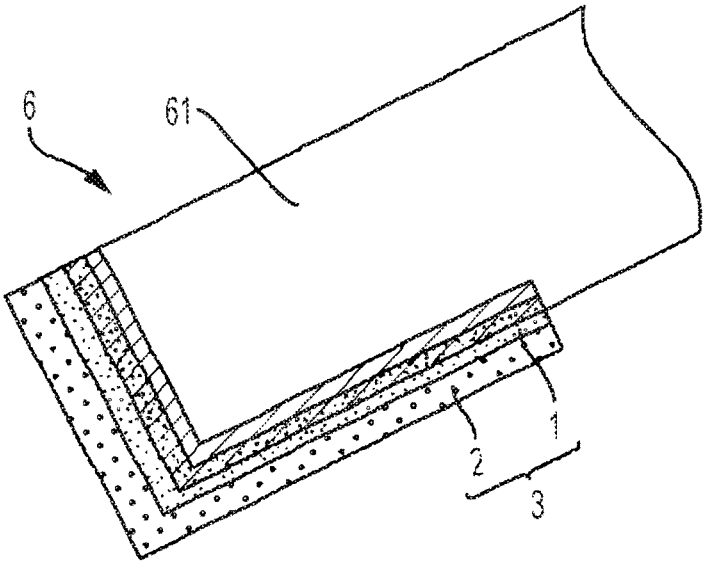
Figure 3:
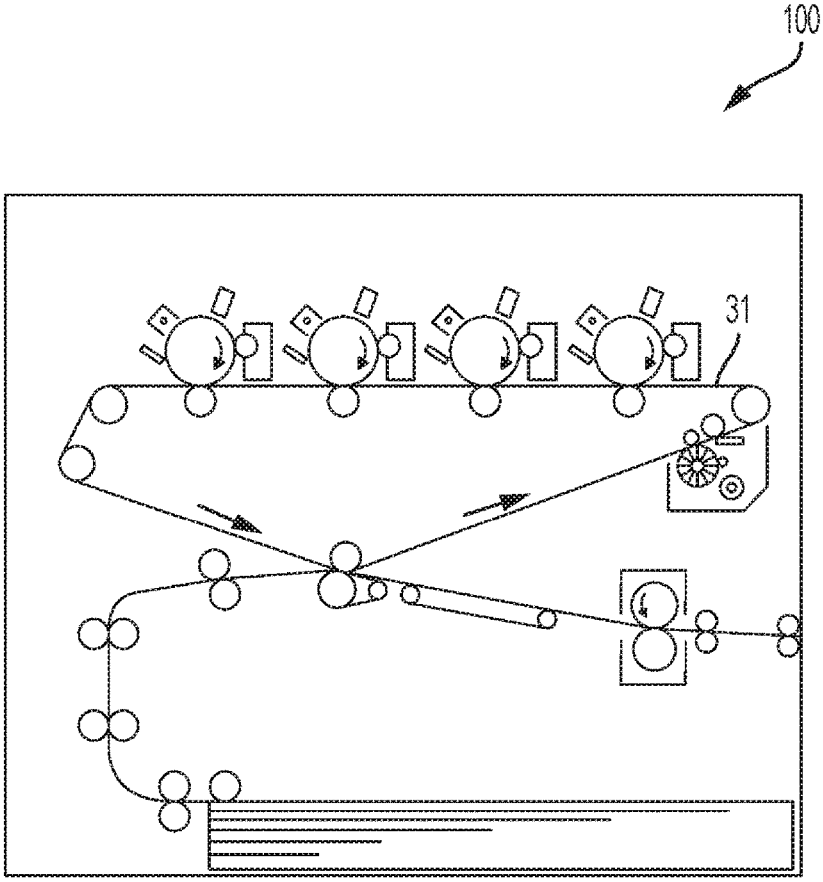
FIG. 3 illustrates a transfer device 100 including a cleaning belt 31.
Figure 4:
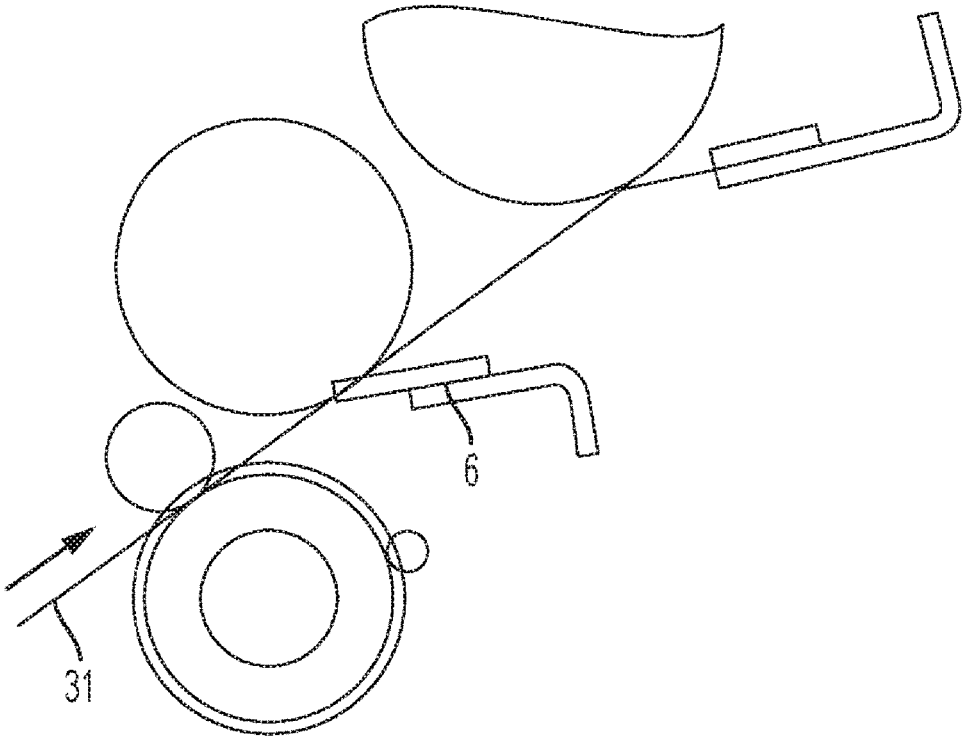
FIG. 4 illustrates the cleaning belt 31 and the cleaning blade 6.
Figure 5:
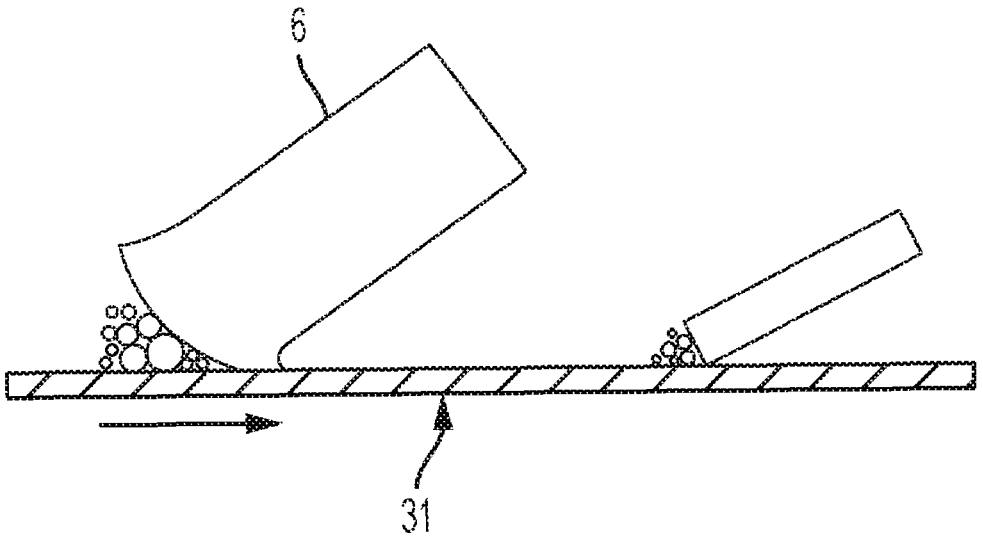
FIG. 5 is another illustration of the cleaning belt 31 and the cleaning blade 6.
Figure 6:
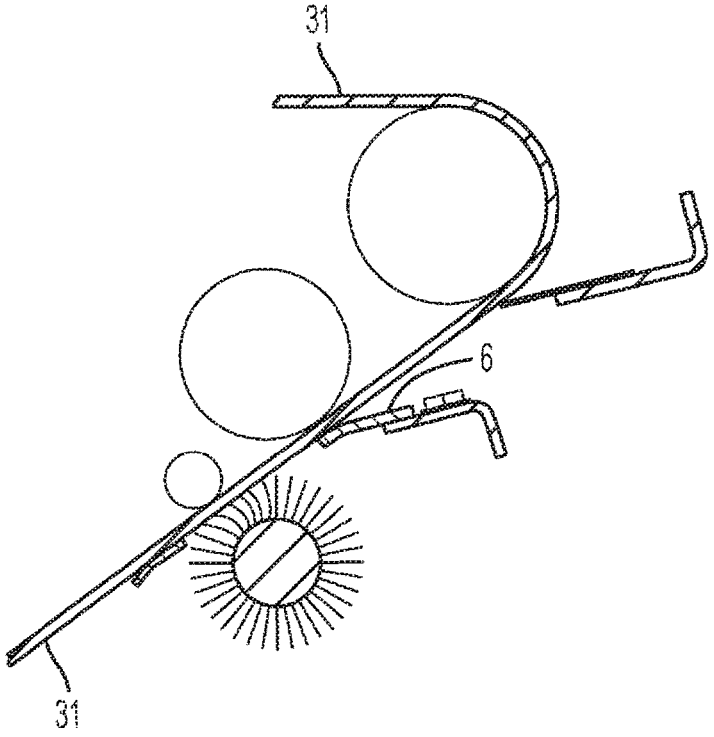
FIG. 6 is another illustration of the cleaning belt 31 and the cleaning blade 6.

In image forming apparatuses, a cleaning device is provided to remove a developer remaining on an image carrier or an intermediate transfer belt. An example of the cleaning device is a cleaning blade that includes a substrate formed of a resin, such as polyurethane rubber, and that has an elasticity.

Such a cleaning blade is disposed such that its edge is in contact with a member to be cleaned, and this member is rubbed with the cleaning blade so that a remaining developer is scraped off by the edge. The cleaning blade serves as the cleaning device in this manner.

A cleaning blade used in the transfer device of an exemplary embodiment will now be described. The cleaning blade used in this exemplary embodiment includes a blade substrate and a coating layer that covers the surface of the blade substrate.

The blade substrate is a resin substrate having a substantially planar shape, and at least one edge thereof is covered with the coating layer that contains diamond-like carbon as the principle component. This covered edge serves as the part that is in contact with a belt, which is an object to be cleaned, when the cleaning blade is attached in an image forming apparatus.

The blade substrate itself that has not been covered with the coating layer yet is equivalent to an elastic blade that is generally used. The coating layer has a hardness and a small coefficient of friction, which may enhance the wear resistance of the part that is in contact with an object to be cleaned and reduce the friction thereof. In other words, as compared with the case where the blade substrate is directly in contact with the belt, resistance to wear brought about by rubbing the belt is enhanced, and friction with belt is reduced.

Such an enhancement in wear resistance contributes to the prolonged lifetime of the cleaning blade, and the reduction in the friction contributes to an improvement in the cleaning performance thereof.

The resin substrate of the blade substrate can be any of various elastic substrates that are generally used as non-metal cleaning blades. Examples thereof include substrates formed of rubber materials that are known for having elasticity and shape restoration properties, such as polyurethane rubber, silicone rubber, fluororubber, propylene rubber, and butadiene rubber.

It is suitable that the hardness of the rubber material measured in accordance with JIS-A be approximately from 70 to 85.

The coating layer is formed so as to cover at least one edge of the resin substrate having a substantially planar shape and basically a diamond-like carbon (DLC) film; however, the coating layer has a connection layer formed so as to face the interface with the resin substrate in order to further enhance the adhesion of the coating layer to the resin substrate.

The connection layer contains DLC, which is the principle component of the coating layer, as well as at least any of titanium nitride, titanium carbide, titanium carbonitride, titanium silicon, chromium nitride, tungsten carbide, silicon carbide, and titanium tungsten as an anchor material.

The surface layer formed of DLC and covering the connection layer suitably has a thickness ranging approximately from 0.05 μm to 0.3 μm. The larger the thickness of the surface layer is, the harder it becomes that the coating layer follows an elastic change in the shape of the substrate, which results in the easy peeling of the layer. In the case where the surface layer has an unnecessarily small thickness, the reduction in the coefficient of friction of the surface of the blade member, which is the effect brought about by forming the DLC film, becomes insufficient.

The coating film can be formed by a variety of vapor deposition techniques that are generally used to deposit DLC on the surface of the substrate, such as physical vapor deposition (PVD) and chemical vapor deposition (CVD).

The coating layer can be formed by, for example, microwave plasma CVD, direct plasma CVD, Rf plasma CVD, effective magnetic field plasma CVD, ion beam sputtering, ion beam deposition, reactive plasma sputtering, and unbalanced magnetron sputtering.

The source gas used in the formation of the coating layer is carbon-containing gas. Examples thereof include hydrocarbon gas such as methane, ethane, propane, ethylene, benzene, and acetylene; halocarbon such as methylene chloride, carbon tetrachloride, chloroform, and trichloroethane; alcohols such as methyl alcohol and ethyl alcohol; ketones such as acetone and diphenyl ketone; gas such as carbon monoxide and carbon dioxide; and mixtures thereof with $N_2$, $H_2$, $O_2$, $H_2O$, or Ar.

Among a variety of deposition techniques, Filtered Cathodic Vacuum Arc (FCVA) that is ion beam deposition involving use of an arc plasma source is suitably used to form the coating layer.

In FCVA that is one of PVD techniques, carbon is taken directly out of a solid carbon source; thus, as compared with plasma CVD techniques in which hydrocarbon gas is used as a carbon source, the FCVA enables formation of a DLC film having a lower hydrogen content. A DLC film formed by FCVA therefore has a further enhanced wear resistance and reduced coefficient of friction.

In the connection layer, it is suitable that the anchor material content be gradually decreased in the direction of the deposition of the coating layer (direction from the interface with the substrate to the surface layer) rather than the state in which carbon and the anchor material are dispersed at a certain ratio. The part formed without the anchor material after the anchor material content reaches zero corresponds to the surface layer of the coating layer. The Vickers hardness of the surface layer formed of diamond-like carbon is approximately 1500 Hv or more.

Hence, particularly the connection layer is suitably formed by FCVA. Use of FCVA enables formation of the film at an accurately adjusted mixture proportions of gas as a carbon source and gas as an ion source (titanium source, chromium source, tungsten source, or silicon source).

Implantation of ion source gas causes the component of the substrate (nitrogen or silicon) or bonding of carbon to a variety of ions to generate the above-mentioned material of the connection layer, such as titanium nitride, titanium carbide, titanium carbonitride, titanium silicon, chromium nitride, silicon carbide, titanium tungsten, and tungsten carbide.

The resin, which serves as the blade substrate, and the DLC film have a gap in modulus hardness due to the difference in the material thereof. It is speculated that an increase in the gap in modulus hardness leads to an increase in the frequency of peeling of the coating layer resulting from repeated elastic deformation. It is therefore suitable that titanium nitride, titanium silicon, titanium carbonitride, or titanium tungsten be generated at the interface between the blade substrate and the coating layer (connection layer) to form a mixture region in which the resin component of the blade substrate (nitride or silicon) and such titanium and tungsten coexist. The presence of the mixture region enables the gradient of modulus hardness from the resin to the coating layer to be moderate, so that the coating layer becomes further less likely to be peeled off from the blade substrate.

Example 1

Cleaning Blade

A blade substrate is produced as follows. Polycaprolactone polyol (PLACCEL 205 manufactured by Daicel Chemical Industries, Ltd., average molecular weight: 529, hydroxyl value: 212 KOHmg/g) and another polycaprolactone polyol (PLACCEL 240 manufactured by Daicel Chemical Industries, Ltd., average molecular weight: 4155, hydroxyl value: 27 KOHmg/g) are prepared as soft segment materials of polyol components. An acrylic resin having two or more hydroxyl groups (ACTFLOW UMB-2005B manufactured by Soken Chemical & Engineering Co., Ltd.) is prepared as a hard segment material. The soft segment materials and the hard segment material are mixed with each other at a ratio of 8:2 (mass ratio).

Then, 6.26 parts of 4,4'-diphenylmethane diisocyanate (MILLIONATE MT manufactured by Nippon Polyurethane Industry Co., Ltd.) as an isocyanate compound is added to 100 parts of the mixture of the soft segment materials and the hard segment material, and the reaction is carried out under nitrogen atmosphere at 70° C. for 3 hours. The amount of the isocyanate compound used in this reaction is determined so as to adjust the proportion of the isocyanate group to the hydroxyl group in the reaction system (isocyanate group/hydroxyl group) to be 0.5.

Then, 34.3 parts of the isocyanate compound is further added, and the resulting product is subjected to a reaction under nitrogen atmosphere at 70° C. for 3 hours to obtain a prepolymer. The total amount of the isocyanate compound used to obtain the prepolymer is 40.56 parts.

The prepolymer is heated to 100° C. and subsequently defoamed under reduced pressure over 1 hour. Then, 7.14 parts of a mixture of 1,4-butanediol and trimethylolpropane (mass ratio: 60/40) is added to 100 parts of the prepolymer, and they are blended with each other over 3 minutes without generation of foams, thereby preparing a composition used for forming a substrate.

The composition used for forming a substrate is poured into a centrifugal molding machine of which the temperature of the mold has been controlled to be 140° C. and then subjected to a curing reaction for an hour. The resulting product is subjected to an aging heat treatment at 110° C. for 24 hours and then cooled and subsequently cut off to yield a substrate A having a length of 320 mm, a width of 12 mm, and a thickness of 2 mm.

A coating film is formed on the substrate A by FCVA. A DLC film as the coating film can be a pure DLC film containing merely carbon when only carbon is used as an element source; however, in Example 1, gas of a titanium source as an anchor material is mixed with vaporized gas of carbon in the early phase of the deposition in order to form a connection layer having a mixture region that is present at the interface thereof with the substrate, thereby producing a cleaning blade of Example 1.

The composition of the connection layer is analyzed with an X-ray photoelectron spectroscopic analyzer, which shows that the thickness of the surface layer is 200 nm and that the thickness of the connection layer is 133 nm. In addition, the analysis shows that the peak of the concentration of the number of titanium atoms contained in the connection layer is 7% and that a region in which the component of the substrate, titanium, and carbon coexist is present at the interface between the substrate and the coating layer.

This cleaning blade produced as described above and an endless belt having a specular gloss Gs (60°) of 135 at an incident angle of a light source of 60° are attached to a commercially available image forming apparatus (ApeosIV-5575 manufactured by Fuji Xerox Co., Ltd.) to prepare an image forming apparatus of Example 1.

Example 2

An image forming apparatus of Example 2 is prepared as in Example 1 except that the endless belt is changed to an endless belt having Gs (60°) of 129.

Example 3

An image forming apparatus of Example 3 is prepared as in Example 1 except that the endless belt is changed to an endless belt having Gs (60°) of 123.

Example 4

An image forming apparatus of Example 4 is prepared as in Example 1 except that the endless belt is changed to an endless belt having Gs (60°) of 118.

Example 5

An image forming apparatus of Example 5 is prepared as in Example 1 except that the endless belt is changed to an endless belt having Gs (60°) of 110.

Comparative Example 1

An image forming apparatus of Comparative Example 1 is prepared as in Example 1 except that the substrate A itself is used as the cleaning blade in the image forming apparatus without the coating layer being formed.

Comparative Example 2

An image forming apparatus of Comparative Example 2 is prepared as in Example 2 except that the substrate A itself is used as the cleaning blade in the image forming apparatus without the coating layer being formed.

Comparative Example 3

An image forming apparatus of Comparative Example 3 is prepared as in Example 3 except that the substrate A itself is used as the cleaning blade in the image forming apparatus without the coating layer being formed.

Comparative Example 4

An image forming apparatus of Comparative Example 4 is prepared as in Example 4 except that the substrate A itself is used as the cleaning blade in the image forming apparatus without the coating layer being formed.

Comparative Example 5

An image forming apparatus of Comparative Example 5 is prepared as in Example 5 except that the substrate A itself is used as the cleaning blade in the image forming apparatus without the coating layer being formed.

Comparative Example 6

An image forming apparatus of Comparative Example 6 is prepared as in Example 1 except that the endless belt is changed to an endless belt having Gs (60°) of 103.

Comparative Example 7

An image forming apparatus of Comparative Example 7 is prepared as in Comparative Example 6 except that the substrate A itself is used as the cleaning blade in the image forming apparatus without the coating layer being formed.

Comparative Example 8

An image forming apparatus of Comparative Example 8 is prepared as in Example 1 except for the endless belt is changed to an endless belt having Gs (60°) of 141.

Comparative Example 9

An image forming apparatus of Comparative Example 9 is prepared as in Comparative Example 8 except that the substrate A itself is used as the cleaning blade in the image forming apparatus without the coating layer being formed.

Test of Cleaning Performance

Each of the image forming apparatuses of Examples and Comparative Examples is used to perform printing on A4 paper 30000 times, and then the generation of a streak of a stain is observed to evaluate the cleaning quality in Examples and Comparative Examples. Such a streak of a stain is defective printing that occurs when residual toner adhering to the surface of the belt is not sufficiently removed with the cleaning blade. Table 1 shows results of the test.

TABLE 1

| | Specular gloss Gs (60°) of endless belt | Coating layer of cleaning belt | Stain after 30000 times of printing | Evaluation of cleaning quality |
|---|---|---|---|---|
| Example 1 | 135 | Presence | Not observed | Good |
| Comparative Example 1 | 135 | Absence | Observed | Bad |
| Example 2 | 129 | Presence | Not observed | Good |
| Comparative Example 2 | 129 | Absence | Observed | Bad |
| Example 3 | 123 | Presence | Not observed | Good |
| Comparative Example 3 | 123 | Absence | Observed | Bad |
| Example 4 | 118 | Presence | Not observed | Good |
| Comparative Example 4 | 118 | Absence | Observed | Bad |
| Example 5 | 110 | Presence | Not observed | Good |
| Comparative Example 5 | 110 | Absence | Observed | Bad |
| Comparative Example 6 | 103 | Presence | Not observed | Good |
| Comparative Example 7 | 103 | Absence | Observed | Bad |
| Comparative Example 8 | 141 | Presence | Not observed | Good |
| Comparative Example 9 | 141 | Absence | Not observed | Good |

Although not illustrated in Table 1, the turn-up of the cleaning blade is observed in Comparative Examples 5 and 7 in addition to the generation of defective printing. The turn-up of the cleaning blade refers to that the cleaning blade bends as a result of being caught by the belt in the rotational direction of the belt because of the friction thereof against the belt.

Defective printing is found not in each of Examples 1 to 5 but in each of Comparative Examples 1 to 5.

Although the same endless belt having a specular gloss Gs (60°) of 103 is used in Comparative Examples 6 and 7, Comparative Example 6 has the cleaning blade with the coating layer, and Comparative Example 7 has the cleaning blade without the coating layer. Defective printing occurs in Comparative Example 7.

In Comparative Examples 8 and 9 in which the same endless belt having a specular gloss Gs (60°) of 141 is used, one of them has the cleaning blade with the coating layer, and the other one has the cleaning blade without the coating layer; however, defective printing does not occur in both of them.

Accordingly, the results show that the cleaning blade coated with diamond-like carbon has good performance for an endless belt having a specular gloss Gs (60°) ranging from 110 to 141.

As is clear from the result in Comparative Example 9, an endless belt having a specular gloss Gs (60°) of 141 does not suffer from defective printing even when the cleaning blade is not coated with diamond-like carbon. Thus, using the cleaning blade coated with diamond-like carbon in each of Examples in combination with an endless belt having a specular gloss Gs (60°) ranging from 110 to 135 produces a remarkable effect as compared with using the cleaning blade not coated with diamond-like carbon.

From the standard curve illustrated in FIG. 1, the endless belt having a specular gloss Gs (60°) ranging from 110 to 135 corresponds to an endless belt having a surface roughness Rz ranging approximately from 0.05 μm to 0.15 μm. Accordingly, combined use of the cleaning blade coated with diamond-like carbon in each of Examples with an endless belt having a surface roughness Rz ranging approximately from 0.05 μm to 0.15 μm produces a remarkable effect.

INDUSTRIAL APPLICABILITY

The exemplary embodiment of the invention can be applied to a transfer device and an image forming apparatus in the manner described above.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

an endless belt having a surface roughness Rz ranging approximately from 0.05 μm to 0.15 μm; and a cleaning blade that serves to clean the belt and that includes a resin substrate having a substantially planar shape and a coating layer covering at least one edge of the resin substrate, wherein the coating layer has a connection layer and a surface layer, the connection layer is disposed so as to face the interface with the resin substrate and contains diamond-like carbon and at least one selected from the group consisting of titanium nitride, titanium silicon, titanium tungsten, titanium carbide, and titanium carbonitride, and the surface layer covers the connection layer and contains diamond-like carbon.

2. The transfer device according to claim 1, wherein the resin substrate is formed of any one selected from the group consisting of urethane rubber, polyimide rubber, silicone rubber, fluororubber, propylene rubber, and butadiene rubber.

3. The transfer device according to claim 1, wherein a mixture region in which materials of the resin substrate and the coating layer coexist is present at the interface between the resin substrate and the coating layer.

4. The transfer device according to claim 1, wherein a thickness of the surface layer is approximately from 0.05 μm to 0.3 μm.

5. The transfer device according to claim 1, wherein a Vickers hardness of the surface layer is approximately 1500 Hv or more.

6. An image forming apparatus comprising the transfer device according to claim 1.

* * * * *